US011293666B2

(12) United States Patent
Xia et al.

(10) Patent No.: US 11,293,666 B2
(45) Date of Patent: Apr. 5, 2022

(54) SUPERHIGH TEMPERATURE HEAT PUMP SYSTEM AND METHOD CAPABLE OF PREPARING BOILING WATER NOT LOWER THAN 100° C

(71) Applicant: NANJING UNIVERSITY OF AERONAUTICS AND ASTRONAUTICS, Nanjing (CN)

(72) Inventors: Wenqing Xia, Nanjing (CN); Zhuoran Huang, Nanjing (CN); Yuhang Lou, Nanjing (CN)

(73) Assignee: NANJING UNIVERSITY OF AERONAUTICS AND ASTRONAUTICS, Nanjing (CN)

( * ) Notice: Subject to any disclaimer, the term of this patent is extended or adjusted under 35 U.S.C. 154(b) by 136 days.

(21) Appl. No.: 16/475,003

(22) PCT Filed: Sep. 19, 2018

(86) PCT No.: PCT/CN2018/106456
§ 371 (c)(1),
(2) Date: Jun. 28, 2019

(87) PCT Pub. No.: WO2019/020132
PCT Pub. Date: Jan. 31, 2019

(65) Prior Publication Data

US 2019/0316810 A1 Oct. 17, 2019

(30) Foreign Application Priority Data

Nov. 7, 2017 (CN) ..... 201711085103.2

(51) Int. Cl.
*F24H 4/02* (2022.01)
*F25B 30/02* (2006.01)
(Continued)

(52) U.S. Cl.
CPC ..... *F24H 4/02* (2013.01); *F25B 30/02* (2013.01); *F25B 41/20* (2021.01); *F25B 41/31* (2021.01);
(Continued)

(58) Field of Classification Search
CPC .... F24H 4/02; F24H 1/10; F25B 30/02; F25B 30/06; F25B 29/003; F25B 13/00;
(Continued)

(56) References Cited

U.S. PATENT DOCUMENTS 1,328,608 A * 1/1920 Woodward ..... F24H 1/18 122/32
4,327,561 A * 5/1982 McNeal ..... F25B 13/00 62/324.1
(Continued)

FOREIGN PATENT DOCUMENTS

CN 202709449 U 1/2013
CN 104676943 A 6/2015
(Continued)

*Primary Examiner* — Elizabeth J Martin
*Assistant Examiner* — Evan J. Cusick
(74) *Attorney, Agent, or Firm* — Treasure IP Group, LLC

(57) ABSTRACT

Provided are a superhigh temperature heat pump system and method capable of preparing boiling water not lower than 100° C., belonging to the technical field of heat pumps. The system comprises a compressor (1), primary and secondary evaporators (5, 6), an expansion mechanism (4), primary and secondary condenser/coolers (2, 3), water pumps (7, 8, 13), water tanks (9, 10), and a valve (14). The solution is based on the compressor exhaust heat enthalpy utilization minimum entropy gain principles/technology, and utilizes exhaust heat enthalpy sensible heat and latent heat in stages. The present invention has an output water temperature higher than 100° C., expands the functions of current heat pump water heaters which can only prepare hot water lower
(Continued)

than 100° C., and can replace electric water heaters, save energy and increase energy utilization rates.

2 Claims, 2 Drawing Sheets

(51) Int. Cl.
*F25B 41/20* (2021.01)
*F25B 41/31* (2021.01)

(52) U.S. Cl.
CPC ..... *F25B 2309/06* (2013.01); *F25B 2339/047* (2013.01)

(58) Field of Classification Search
CPC . F25B 30/00; F24D 3/18; F24D 11/02; F24D 11/0235; F24D 2200/123
See application file for complete search history.

(56) References Cited

U.S. PATENT DOCUMENTS 4,373,346 A * 2/1983 Hebert ..... F25B 40/00 62/79
5,651,258 A * 7/1997 Harris ..... F24F 3/153 62/90
6,795,644 B2 * 9/2004 Bradenbaugh ..... F24H 9/2021 219/496
9,702,634 B1 * 7/2017 Mankaruse ..... F25B 30/02
2013/0098096 A1 * 4/2013 Nakayama ..... F25B 30/02 62/324.6
2014/0013786 A1 * 1/2014 Kanamaru ..... F25B 7/00 62/238.7
2014/0208791 A1 * 7/2014 Suzuki ..... F24D 3/18 62/324.6
2014/0260392 A1 * 9/2014 Hawkins ..... F25B 29/00 62/238.6
2014/0360218 A1 * 12/2014 Takenaka ..... F25B 13/00 62/324.6
2015/0034073 A1 * 2/2015 Wei ..... F24D 19/106 126/714
2015/0159886 A1 * 6/2015 Bush ..... F24H 4/04 392/308
2015/0377407 A1 * 12/2015 Shinoki ..... B65D 81/3825 428/69
2016/0047555 A1 * 2/2016 Lutfey ..... F24D 11/003 126/714
2016/0061508 A1 * 3/2016 Lowrimore ..... F24H 9/20 62/160
2016/0216011 A1 * 7/2016 Hwang ..... F25B 13/00
2016/0298873 A1 * 10/2016 Chan ..... A47J 27/04
2017/0045903 A1 * 2/2017 Hashimoto ..... H02J 13/00
2017/0067654 A1 * 3/2017 Kawashima ..... C02F 1/001
2017/0082333 A1 * 3/2017 Shimazu ..... F25B 31/004
2017/0130996 A1 * 5/2017 Hatanaka ..... F24F 11/89
2017/0284702 A1 * 10/2017 Boros ..... F25B 1/005
2018/0073748 A1 * 3/2018 Gagne ..... F24D 3/08

FOREIGN PATENT DOCUMENTS

CN 205807905 U 12/2016
CN 107647446 A * 2/2018
CN 207610386 U 7/2018

* cited by examiner

SUPERHIGH TEMPERATURE HEAT PUMP SYSTEM AND METHOD CAPABLE OF PREPARING BOILING WATER NOT LOWER THAN 100° C

CROSS REFERENCE TO RELATED APPLICATION

This application claims priority to a PCT application PCT/CN2018/106456, filed on Sep. 9, 2018, which in turn takes priority of Chinese Application No. 201711085103.2, filed on November, 2017. Both the PCT application and Chinese Application are incorporated herein by reference in their entireties.

BACKGROUND

Technical Field

The present invention relates to a superhigh temperature heat pump system and method capable of preparing boiling water not lower than 100° C., belonging to the field of new energy utilization, and in particular, to a method of utilizing heat enthalpy sensible heat and latent heat in stages and transforming environmental low-grade heat energy into high-grade heat energy through a heat pump technology based on the compressor exhaust heat enthalpy utilization minimum entropy gain principles/technology.

RELATED ART

A heat pump water heater is a novel hot water and heat supply heat pump product, and is a heat and hot water supply device capable of replacing a boiler. According to the principle of a heat pump, it is only required to consume a small amount of electric energy to transfer heat in a low temperature environment to a water heater in a high temperature environment, thereby preparing high temperature hot water by heating. The heat pump water heaters have been put into production and have been widely used in the market. At present, the heat pump water heaters can only prepare hot water not higher than approximately 85° C. However, boiling water is needed for kitchens, boiling water rooms, etc. It is also necessary to electrically heat hot water prepared by an ordinary heat pump water heater to further obtain boiling water. Therefore, how to utilize a heat pump technology to prepare boiling water such that a heat pump has an expanded function of providing living boiling water from providing sanitary hot water has become a breakthrough for further energy conservation and application expansion.

SUMMARY OF THE INVENTION

To overcome the defect that an ordinary heat pump water heater cannot directly prepare boiling water, the present invention is directed to a superhigh temperature heat pump system and method capable of preparing boiling water not lower than 100° C.

The superhigh temperature heat pump system capable of preparing boiling water not lower than 100° C. includes a compressor, a primary condenser/cooler, a secondary condenser/cooler, an expansion mechanism, a primary evaporator, a secondary evaporator, a first water pump, a second water pump, a hot water tank, a boiling water tank, a third water pump, and a valve. The primary condenser/cooler includes a working medium inlet and outlet and a hot water inlet and outlet. The secondary condenser/cooler includes a working medium inlet and outlet, a hot water tank cycling inlet and outlet and an evaporator heat exchange inlet and outlet. The primary evaporator includes a working medium inlet and outlet. The secondary evaporator includes a working medium inlet and outlet and a hot water inlet and outlet. The hot water tank has a water inlet, a hot water outlet, a hot water inlet and a faucet. The boiling water tank has an exhaust hole, a hot water outlet and a boiling water inlet, and hot water and boiling water in the boiling water tank are separated. An outlet of the compressor is connected to the working medium inlet of the primary condenser/cooler. The working medium outlet of the primary condenser/cooler is connected to the working medium inlet of the secondary condenser/cooler. The working medium outlet of the secondary condenser/cooler is connected to an inlet of the primary evaporator through the expansion mechanism. An outlet of the primary evaporator is connected to the working medium inlet of the secondary evaporator, and the working medium outlet of the secondary evaporator is connected to an inlet of the compressor. The evaporator heat exchange outlet of the secondary condenser/cooler is connected to the hot water inlet of the secondary evaporator through the valve, and the hot water outlet of the secondary evaporator is connected to the evaporator heat exchange inlet of the secondary condenser/cooler through the third water pump. The hot water outlet of the hot water tank is connected to the hot water inlet of the secondary condenser/cooler through the first water pump, and the hot water outlet of the secondary condenser/cooler is connected to the hot water inlet of the hot water tank. The hot water tank and the boiling water tank are connected through a one-way flow regulating valve. In addition, the hot water outlet of the boiling water tank is connected to the hot water inlet of the primary condenser/cooler through the second water pump, and the hot water outlet of the primary condenser/cooler is connected to the boiling water inlet of the boiling water tank.

In the method for the superhigh temperature heat pump system capable of preparing boiling water not lower than 100° C., a thermal cycle process of a working medium is as follows: a working medium from the compressor is controlled to be not lower than 110° C., the working medium sequentially enters the primary condenser/cooler and the secondary condenser/cooler for heat release, is then throttled and cooled by the expansion mechanism and enters the primary evaporator and the secondary evaporator for heat absorption, and finally enters the compressor for temperature and pressure rises, thus completing a thermal cycle engineering; a flow of cycling hot water between the boiling water tank and the primary condenser/cooler is controlled to be lower than a flow of cycling hot water between the hot water tank and the secondary condenser/cooler; and cycling water and working medium exergy are optimally matched, a matching relationship is determined according to a formula: $G_w C_p \Delta T_w = M_r \Delta h_r$, and a cycling thermal utilization rate is maximum, where the left side is a water flow $G_w$, a specific heat capacity $C_p$ and a water temperature rise $\Delta T_w$, and the right side is a refrigerant flow $M_r$ and an enthalpy drop $\Delta h_r$; and a hot water cycling system is as follows: after entering the hot water tank, normal temperature water is pumped into the secondary condenser/cooler through the first water pump to absorb heat to turn into hot water of approximately 65° C., and be stored in the hot water tank; hot water enters the boiling water tank through a one-way flow regulating pipeline, is pumped into the primary condenser/cooler through the second water pump to further absorb heat to turn into boiling water of 100° C. and be stored in a boiling water portion of the boiling water tank, the water inlet serving as a water inlet passage and the exhaust hole serving as a steam discharge port; water in the hot water tank flows into the boiling water tank in one direction, and both the hot water tank and the boiling water tank may separately drain off the water through the faucet; in order to make the working medium not lower than 110° C. at the outlet of the compressor, it is necessary to increase the temperature of a heat source or increase the superheat of the working medium at the inlet of the compressor; and in this case, the third water pump pumps the water into the secondary condenser/cooler for heat absorption, and then the water enters the secondary evaporator through the valve for heat release, such that the working medium further absorbs heat to increase the temperature, or increases the evaporation temperature.

For a transcritical cycle heat pump system of carbon dioxide and the like, based on the principle of a nonlinear temperature enthalpy and exergy trapping technology, although a heat release process has no phase change condensation, the nonlinear temperature enthalpy of a working medium is similar to that of a working medium in a condensation process, step cooling is also required, hot water and boiling water are separately prepared and are generally not equal in flow. Except that there is no phase change heat exchange, the transcritical cycle is basically the same as a subcritical cycle.

Compared with the prior art, the system and method of the present invention are based on the compressor exhaust heat enthalpy utilization minimum entropy gain principles/technology, and utilize exhaust heat enthalpy sensible heat and latent heat in stages for a subcritical cycle, and in the system and method, condensers are divided into primary and secondary condensers. Firstly, normal temperature water passes through a secondary condenser/working medium condensation section, and latent heat of a working medium of approximately 70° C. is absorbed by counter flow heat exchange, so that the normal temperature water turns into hot water of approximately 65° C. Then, in a primary condenser/working medium superheat constant pressure cooling section, sensible heat is further absorbed by counter flow heat exchange, so that the hot water turns into boiling water of 100° C. In the present invention, evaporators are divided into primary and secondary evaporators. In order to increase the superheat of a working medium, the working medium may enter the secondary evaporator to further absorb heat after absorbing heat in the primary evaporator. Alternatively, in some cases, an environmental heat source makes an evaporation temperature excessively low, and the heat of the hot water may be directly absorbed.

Figure 1:
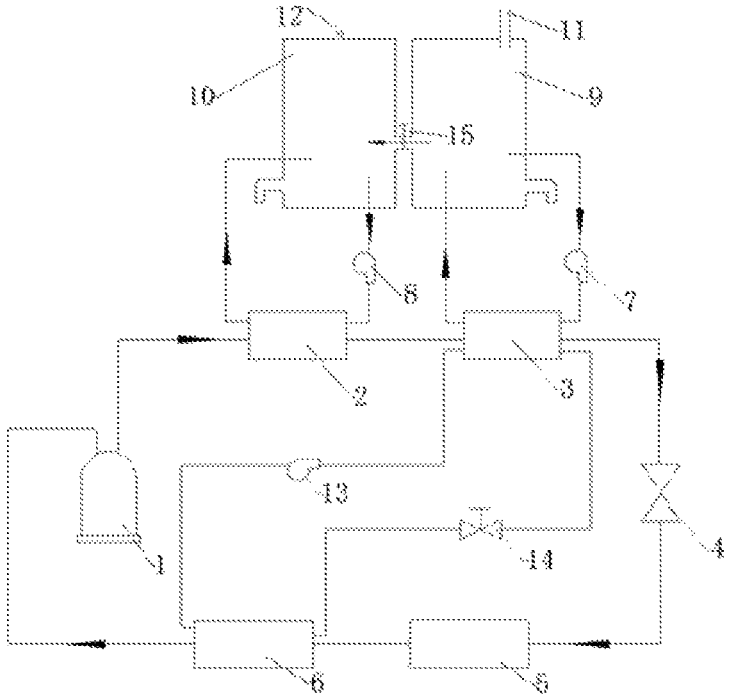
FIG. 1 is a system principle diagram of the present invention.

Reference numerals in FIG. 1 are: 1-Compressor, 2-Primary condenser/cooler, 3-Secondary condenser/cooler, 4-Expansion mechanism, 5-Primary evaporator, 6-Secondary evaporator, 7-First water pump, 8-Second water pump, 9-Hot water tank, 10-Boiling water tank, 11-Water inlet, 12-Exhaust hole, 13-Third water pump, 14-Valve, 15-One-way flow valve.

Figure 2:
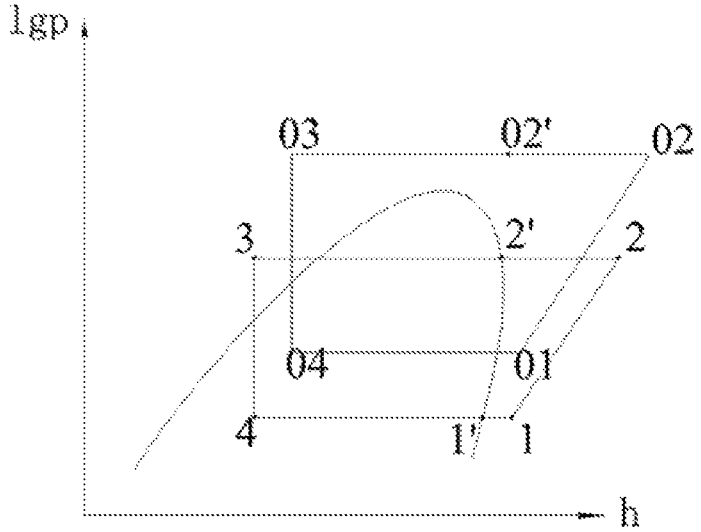
FIG. 2 is a pressure-enthalpy diagram of subcritical and transcritical cycle systems of the present invention.

Reference numerals in FIG. 2 are: 1-Subcritical compressor inlet, 2-Subcritical compressor outlet, 2'-High pressure dry saturated state point, 3-Subcritical condenser outlet, 4-Subcritical evaporator inlet, 1'-Low pressure dry saturated state point, 01-Transcritical compressor inlet, 02-Transcritical compressor outlet, 02'-Stage cooling state point, 03-Transcritical cooler outlet, 04-Transcritical evaporator inlet.

Figure 3:
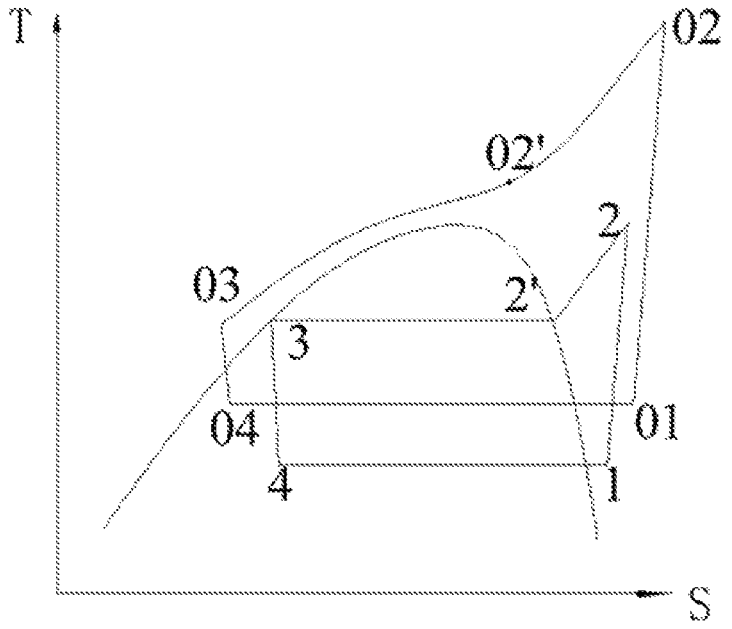
FIG. 3 is a temperature-enthalpy diagram of the subcritical and transcritical cycle systems of the present invention.

Reference numerals in FIG. 3 are: 1-Subcritical compressor inlet, 2-Subcritical compressor outlet, 2'-Condenser stage cooling state point, 3-Condenser outlet, 4-Subcritical evaporator inlet, 01-Transcritical compressor inlet, 02-Transcritical compressor outlet, 02'-Stage cooling state point, 03-Transcritical cooler outlet, 04-Transcritical evaporator inlet.

DETAILED DESCRIPTION

The content of the present invention will be further described below with reference to specific embodiments and the accompanying drawings.

FIG. 1 is a principle diagram of a superhigh temperature heat pump system. A working medium from a compressor 1 is controlled to be not lower than 110° C. The working medium sequentially enters a primary condenser/cooler 2 and a secondary condenser/cooler 3 for heat release, is then throttled and cooled by an expansion mechanism 4 and enters a primary evaporator 5 and a secondary evaporator 6 for heat absorption, and finally enters the compressor for temperature and pressure rises, thus completing a thermal cycle engineering.

After entering a hot water tank 9, normal temperature water is pumped into the secondary condenser/cooler 3 through a first water pump 8 to absorb heat to turn into hot water of approximately 65° C., and be stored in the hot water tank 9. Hot water enters a boiling water tank 10 through a pipeline, is pumped into the primary condenser/cooler 2 through a first water pump 7 to further absorb heat to turn into boiling water of approximately 100° C. and be stored in the boiling water tank 10. A water inlet 11 serves as a water inlet passage, and an exhaust hole 12 serves as a steam discharge port. The flows of hot water entering the primary and secondary condenser/coolers are not equal, and a flow of cycling hot water of the boiling water tank is lower than a flow of cycling hot water of the hot water tank, in order to optimally match cycling water and working medium exergy. A matching relationship is determined according to a formula: $G_w C_p \Delta T_w = M_r \Delta h_r$, where the left side is a water flow $G_w$, a specific heat capacity $C_p$ and a water temperature rise $\Delta T_w$, and the right side is a refrigerant flow $M_r$ and an enthalpy drop $\Delta h_r$. The enthalpy drop $\Delta h_r$, of superheat sensible heat is lower than the condensing enthalpy drop $\Delta h_r$, of latent heat, and the refrigerant flow $M_r$ is constant. Therefore, in order to achieve a large water temperature rise $\Delta T_w$, the water flow $G_w$ needs to be reduced, so that an output water temperature can be higher than 100° C., and a cycling thermal utilization rate is maximized.

In order to make the working medium not lower than 110° C. at the outlet of the compressor, it is necessary to increase the temperature of a heat source or increase the superheat of the working medium at the inlet of the compressor. In this case, a third water pump 13 pumps water into the secondary condenser/cooler 3 for heat absorption, and then the water enters the secondary evaporator 6 through a valve 14 for heat release, such that the working medium further absorbs heat to increase the temperature, or increases the evaporation temperature.

FIG. 2 is a pressure-enthalpy diagram of the superhigh temperature heat pump system. For a subcritical cycle, a working medium reaches a state point 1 at an evaporator outlet, enters a compressor to be compressed to reach a state point 2, enters a primary condenser for heat release to reach a state point 2' (sensible heat part), enters a secondary condenser for heat release to reach a state point 3 (latent heat part), is throttled and depressurized to reach a state point 4, enters a primary evaporator to absorb an environmental heat source, may absorb heat of the secondary condenser at a secondary evaporator according to different working conditions, and then returns to the state point 1, thus completing a thermal cycle process. For a transcritical cycle, the process is the same, except that the condenser is replaced with a cooler.

FIG. 3 is a temperature-enthalpy diagram of the superhigh temperature heat pump system. For a transcritical cycle, a working medium reaches a state point 01 at an evaporator outlet, enters a compressor to be compressed to reach a state point 02, enters a primary cooler for heat release to reach a state point 02', enters a secondary cooler for heat release to reach a state point 03, is throttled and depressurized to reach a state point 04, enters a primary evaporator to absorb an environmental heat source, may absorb heat of the secondary cooler at a secondary evaporator according to different working conditions, and then returns to the state point 01, thus completing a thermal cycle process. For a transcritical cycle heat pump system of carbon dioxide and the like, based on the principle of a nonlinear temperature enthalpy and exergy trapping technology, although a heat release process has no phase change condensation, the nonlinear temperature enthalpy of a working medium is similar to that of a working medium in a condensation process, step cooling is also required, hot water and boiling water are separately prepared and are generally not equal in flow. Except that there is no phase change heat exchange, the transcritical cycle is basically the same as a subcritical cycle.

What is claimed is:

1. A superhigh temperature heat pump system, comprising:

a compressor (1), a primary condenser/cooler (2), a secondary condenser/cooler (3), an expansion mechanism (4), a primary evaporator (5), a secondary evaporator (6), a first water pump (7), a second water pump (8), a hot water tank (9), a boiling water tank (10), a third water pump (13), and a water valve (14), wherein the primary condenser/cooler (2) comprises a working medium inlet and outlet and a hot water inlet and outlet, the secondary condenser/cooler (3) comprises a working medium inlet and outlet, a hot water tank cycling inlet and outlet and an evaporator heat exchange inlet and outlet, the primary evaporator (5) comprises a working medium inlet and outlet, the secondary evaporator (6) comprises a working medium inlet and outlet and a hot water inlet and outlet, the hot water tank (9) has a water inlet (11), a hot water outlet, a hot water inlet and a faucet, the boiling water tank (10) has an exhaust hole (12), a hot water outlet and a boiling water inlet, wherein the hot water tank (9), is configured to receive room temperature water first and send the room temperature water to the secondary condenser/cooler (3) through the first water pump (7) to absorb heat to turn into hot water at 65° C.; then the hot water at 65° C. is sent back to and be stored at the hot water tank (9);

the boiling water tank (10), is configured to receive the hot water from the hot water tank (9), and send the hot water to the primary condenser/cooler (2), through the second water pump (8) to further absorb heat and turn into boiling water at 100° C., and sent back to and be stored at the boiling water tank (10);

the flow amount of the room temperature water entering the secondary condenser/cooler (3) and flow amount of the hot water entering the first condenser/cooler are not equal, and cycling amount of the hot water in the boiling water tank (10) is less than a cycling amount of the room temperature water of the hot water tank (9), in order to match cycling water heat absorption and working medium exergy;

said superhigh temperature heat pump system is configured to only allow hot water having a temperature not lower than 100° C. to exit the boiling water tank;

an outlet of the compressor (1) is connected to the working medium inlet of the primary condenser/cooler (2), the working medium outlet of the primary condenser/cooler (2) is connected to the working medium inlet of the secondary condenser/cooler (3), the working medium outlet of the secondary condenser/cooler (3) is connected to an inlet of the primary evaporator (5) through the expansion mechanism (4), an outlet of the primary evaporator (5) is connected to the working medium inlet of the secondary evaporator (6), and the working medium outlet of the secondary evaporator (6) is connected to an inlet of the compressor (1), wherein the working medium passes through both primary condenser/cooler (2) to increase the temperature of the hot water thereof;

the evaporator heat exchange outlet of the secondary condenser/cooler (3) is connected to the hot water inlet or outlet of the secondary evaporator (6) through the water valve (14) for water passage, and the hot water outlet or inlet of the secondary evaporator (6) is connected to the evaporator heat exchange inlet of the secondary condenser/cooler (3) through the third water pump (13) and said secondary condenser/cooler (3) is configured to bring the temperature of hot water to 65° C.;

the hot water outlet of the hot water tank (9) is connected to the hot water inlet of the secondary condenser/cooler (3) through the first water pump (7), and the hot water outlet of the secondary condenser/cooler (3) is connected to the hot water inlet of the hot water tank (9); and the hot water tank (9) and the boiling water tank (10) are connected through a one-way flow regulating valve (15), in addition, the hot water outlet of the boiling water tank is connected to the hot water inlet of the primary condenser/cooler (2) through the second water pump (8), and the hot water outlet of the primary condenser/cooler (2) is connected to the boiling water inlet of the boiling water tank.

2. A method for preparing boiling water not lower than 100° C. by using the superhigh temperature heat pump system according to claim 1, comprising operating a thermal cycle process of a working medium as the following:

controlling the working medium from the compressor (1) at a temperature not lower than 110° C., letting the working medium sequentially enter into the primary condenser/cooler (2) and the secondary condenser/cooler (3) for heat release, then be throttled and cooled by the expansion mechanism (4), and enter into the primary evaporator (5) and the secondary evaporator (6) for heat absorption, and finally enter into the compressor for temperature and pressure increase, thus completing a thermal cycle;

wherein a flow of cycling hot water between the boiling water tank (10) and the primary condenser/cooler (2) is controlled to be lower than a flow of cycling hot water between the hot water tank (9) and the secondary condenser/cooler (3); and cycling water and working medium exergy are matched according to a matching relationship, which is determined by a formula:

$G_w C_p \Delta T_w = M_r \Delta h_r$, and a cycling thermal utilization rate is at maximum, wherein the left side is a water flow $G_w$, a specific heat capacity $C_p$ and a water temperature rise $\Delta T_w$, and the right side is a refrigerant flow $M_r$ and an enthalpy drop $\Delta h_r$; and providing a hot water cycling system characterized by the following steps:

pumping ambient temperature water into the secondary condenser/cooler (3), after entering into hot water tank (9), through the first water pump (7), to absorb heat to turn into hot water at 65° C., and be stored in the hot water tank (9);

letting hot water enter into the boiling water tank (10) through a one-way flow regulating valve, and pumping the hot water into the primary condenser/cooler (2) through the second water pump (8) to further absorb heat to turn into boiling water at 100° C., wherein the water inlet (11) serves as a water inlet passage and the exhaust hole (12) serves as a steam discharge port;

sending water in the hot water tank into the boiling water tank in one direction, and both the hot water tank and the boiling water tank separately drain off the water through their respective faucets;

making the working medium not lower than 110° C. at the outlet of the compressor, by increasing the temperature of a heat source or increasing the superheat of the working medium at the inlet of the compressor including, pumping the water into the secondary condenser/cooler (3) for heat absorption, by the third water pump (13), and then the water enters the secondary evaporator (6) through the valve (14) for heat release, such that the working medium further absorbs heat to increase the temperature, or increases the evaporation temperature.

* * * * *